US005916136A

United States Patent [19]

Ettere

[11] Patent Number: 5,916,136

[45] Date of Patent: Jun. 29, 1999

[54] ASPIRATION DEVICE FOR VEHICLE ENGINE EXHAUST SYSTEM

[76] Inventor: Mark Ettere, 456 Victoria Way, Piscataway, N.J. 08854

[21] Appl. No.: 08/942,773

[22] Filed: Oct. 2, 1997

[51] Int. Cl.[6] ..... F02B 35/00

[52] U.S. Cl. ..... 60/316; 60/324

[58] Field of Search ..... 60/316, 324

[56] References Cited

U.S. PATENT DOCUMENTS

| | | | |
|---|---|---|---|
| 1,217,615 | 1/1917 | McDowell | 60/316 |
| 2,386,305 | 10/1945 | Flickinger | 60/324 |
| 3,425,216 | 2/1969 | Bjork . | |
| 3,857,458 | 12/1974 | Ohtani et al. . | |
| 4,142,606 | 3/1979 | Vanderzanden et al. . | |
| 4,147,230 | 4/1979 | Ormond et al. . | |
| 4,335,575 | 6/1982 | Pagliuca . | |
| 4,697,668 | 10/1987 | Barker . | |
| 4,741,411 | 5/1988 | Stricker . | |
| 4,807,439 | 2/1989 | Hain et al. . | |
| 4,846,301 | 7/1989 | Granath et al. . | |
| 4,846,302 | 7/1989 | Hetherington . | |
| 5,058,703 | 10/1991 | Ealba et al. . | |
| 5,058,704 | 10/1991 | Yu . | |
| 5,162,620 | 11/1992 | Ross et al. . | |
| 5,165,231 | 11/1992 | Rich | 60/316 |
| 5,174,113 | 12/1992 | Deville . | |
| 5,371,331 | 12/1994 | Wall . | |
| 5,431,013 | 7/1995 | Yamaki . | |

FOREIGN PATENT DOCUMENTS

| | | | |
|---|---|---|---|
| 90043 | 9/1957 | Norway | 60/316 |
| 772587 | 4/1957 | United Kingdom | 60/316 |

*Primary Examiner*—Thomas E. Denion
*Attorney, Agent, or Firm*—Kenneth P. Glynn, Esq.

[57] ABSTRACT

The aspiration device for vehicle engine exhaust systems includes a main housing having a top, a bottom and sidewalls with an open front and an open back. The open front has a larger cross-sectional area than the back and it is adapted to be mounted in the air stream of a vehicle. The device has an aerodynamic wing and a hollow inside with a wide leading edge and a narrow trailing edge and can be mounted within the main housing such that the leading edge of the wing faces the open front of the main housing. The trailing edge of the aerodynamic wing faces the open back of the main housing. The wing is located within the main housing so as to permit passage of air over and under the wing when the device is mounted in the air stream of a vehicle and the vehicle is moving forward. The wing has an exhaust outlet at the trailing edge and the wing has an exhaust inlet located on a sidewall of the main housing for attachment to a vehicle exhaust system.

7 Claims, 3 Drawing Sheets

ASPIRATION DEVICE FOR VEHICLE ENGINE EXHAUST SYSTEM

BACKGROUND OF THE INVENTION

1. Field of the Invention

The present invention is directed to vehicles that move through an air stream and especially to enhancing efficiency of vehicle engines by providing a device for aspirating engine exhaust systems to reduce engine load normally expended to expel exhaust gases from the engine through the exhaust system. Thus, the present invention relates to an aspiration device for exhaust systems of burning fuel-based engine driven vehicles.

2. Information Disclosure Statement

The following patents are representative of prior art relating to motor vehicle exhaust system modifications:

U.S. Pat. No. 5,431,013 to Yamaki et al describes an engine exhaust apparatus which includes a sound suppressing section for lowering the exhaust noise level as an exhaust gas discharged from the exhaust port passes through it. The exhaust apparatus is provided with an ejector section for introducing secondary air into the exhaust gas delivered from the sound suppressing section and mixing the gases, and a post-treatment section for purifying the gas mixture delivered from the ejector section. The exhaust gas discharged from an exhaust manifold gets into the ejector section through the sound suppressing section, and is then purified in the post-treatment section. Therefore, the ejector effect cannot be reduced by the sound suppressing section which is subject to high flow resistance. Thus, the exhaust noise level can be lowered with the ejector effect of the introduction of the secondary air improved considerably, and low cost and simple construction can be enjoyed.

U.S. Pat. No. 5,174,113 to Deville describes an exhaust outlet with venturi is disclosed, including an upstream portion in the form of a venturi, defined by upstream walls converging at an open angle and connected, in a narrowed portion to downstream walls diverging at a more reduced angle and a cylindrical downstream portion connected continuously to the downstream walls of the upstream portion. The presence of the upstream portion in the form of a venturi substantially reduces the backlash noise without substantially affecting the available power of the engine.

U.S. Pat. No. 5,162,620 to Ross et al describes an elongated exhaust gas muffler for a turbine engine which includes a foraminous central exhaust duct which is circumscribed along its length by a plurality of tuned dissipative and reactive noise attenuation chambers. At an inlet end of the muffler an annular secondary flow inlet is defined about the central exhaust duct and opens to the first sound attenuation chamber. A secondary flow of pressurized bleed air is receivable into the first attenuation treatment in the muffler.

U.S. Pat. No. 5,058,704 to Yu describes an improved muffler including a body with an exhaust inlet in the form of a porus pipe enclosed in a second porus pipe for diffusing exhaust gases into the interior of the body. A pair of pipes introduce ambient air into the discharge region of the muffler. A constricted discharge opening of the body encircles the pipes and confine helical vanes which impart a helical path to the exhaust gases just before mixing with ambient air from the pipes. A venturi section with a bell shaped outlet completes the tailpipe section. An auxiliary air inlet to the venturi adds additional ambient air to the final outlet via ports. In an additional embodiment, the venturi section is within the muffler body. A constricted tube provides a direct path for a portion of the exhaust gases while the major quantity of exhaust gases traverse the helical paths defined by the vanes.

U.S. Pat. No. 4,846,301 to Granath et al describes a silencer which contains two chambers separated by a partition wall and includes also a guide plate guiding cooling air from a fan through a channel in which recesses from one chamber terminate. By means of an ejecting function, then being formed, exhaust gases are evacuated into the channel and mixed with the cooling air to a lower temperature.

U.S. Pat. No. 4,807,439 to Hain et al describes an exhaust gas system with a silencer for an internal combustion engine supercharged by a turbocharger which includes a main line leading to the turbine of the turbocharger and a bypass line bypassing the turbine. The main line and the bypass line terminate in the silencer aligned to one another in such a manner that the exhaust gas flow of the main line exerts an ejector action on the exhaust gas flow of the bypass line.

U.S. Pat. No. 4,741,411 to Stricker describes an improved muffler system for mounting within a restricted engine compartment such as the engine compartment of a small off-road vehicle including a muffler surrounded by a heat shield having a plurality of apertures formed for selectively cooling selected certain areas of the engine compartment in conjunction with a venturi which creates a flow of cooling air from outside the engine compartment, over the engine, into the apertures, between the heat shield and the muffler to a point where the exhaust gas and the initially cooler air are mixed and subsequently exited into the atmosphere.

U.S. Pat. No. 4,697,668 to Barker describes an aspirating muffler having a simplified venturi construction. The muffler includes a body having an inlet pipe connected to the exhaust system of an engine and having an outlet pipe. The upstream end of the outlet pipe is rolled inwardly to provide the end with a reduced cross sectional area which defines a venturi. An aspirating tube which is connected to an air cleaner pre-cleaner for the engine communicates with the venturi and flow of exhaust gas through the venturi end of the outlet pipe creates an aspirating action to draw solid particles from the pre-cleaner and discharge the particles through the outlet pipe to the atmosphere.

U.S. Pat. No. 4,335,575 to Pagliuca describes an exhaust gas pressure reducer for an internal combustion engine which includes a housing having means for attaching the housing to the end of the exhaust pipe. The housing has one or more venturi restrictions and is open at the ends for creating a draft across the end of the exhaust pipe through the venturi and out the opposite open end of the housing. The open exit of the housing reduces pressure at the exit to the venturi assisting drawing exhaust gases from the exhaust pipe.

U.S. Pat. No. 4,846,302 to Hetherington describes a sound attenuating muffler for motor vehicle exhaust systems contains a fibrous glass cartridge with a binderhardened outer shell surrounding a soft fibrous core through which a gas flow tube extends.

U.S. Pat. No. 5,058,703 to Ealba et al describes an automotive exhaust tailpipe which reduces noise and has a convoluted surface at or near its outlet to generate pairs of counterrotating axial vortices within the exhaust gases just before or just as the gases exit the tailpipe. The convoluted surface may be the internal surface of the tailpipe, or a thin-walled convoluted member may be disposed within the tailpipe near its outlet end.

U.S. Pat. No. 4,147,230 to Ormond et al relates to a spark arrestor aspirating muffler for an internal combustion engine which comprises an outer body or housing having an exhaust gas inlet in one end and a gas outlet in the opposite end. Located immediately upstream of the outlet is a venturi and air is drawn into the throat of venturi through an air inlet tube connected to a pre-cleaner for the engine. A baffle plate containing a series of louvered openings is positioned upstream of the venturi and the exhaust gasses entering the gas inlet conduit are swirled outwardly as they pass through the louvered openings and are discharged through the venturi. The solid particles in the swirling exhaust gas are thrown outwardly and move along the inner surface of a tubular member which is secured to the downstream side of the baffle and are collected in a collection chamber.

U.S. Pat. No. 4,142,606 to Vanderzanden et al relates to a system for diffusing exhaust gases and controlling and suppressing backfire in an industrial truck is disclosed. Exhaust gases from the truck engine are first passed through a spark arresting muffler to remove hot, solid particles from the gas stream. The gases are then routed to a diffuser which is mounted on the truck's overhead guard. The diffuser contains a venturi and an air intake manifold to mix outside air with the gas stream and complete the ignition of unburned backfire gases. The diffuser includes a transverse diffusion chamber for substantially containing and burning backfires therein and a series of thin exit pipes for dispersing the gases and quenching exiting flames produced by the backfires within the chamber.

U.S. Pat. No. 3,857,458 to Ohtani et al relates to an exhaust gas outlet means for an internal combustion engine comprising an exhaust pipe having an outlet end of a flattened cross-sectional configuration with a width smaller than diameter of unflattened portion and an open-ended fresh air suction pipe disposed with a clearance with the exhaust pipe and having a portion of reduced cross-sectional area around the outlet end of the exhaust pipe so as to define a suction throat in the vicinity of said outlet end.

U.S. Pat. No. 3,425,216 to Bjork relates to a pollution reducing muffler for internal combustion engines having a fresh air aspirating inlet for exhaust gases, and a long narrow gas receiving chamber connected along one side to a similar parallel gas discharge chamber through multiple passages for distributing the gases in their path of travel through the muffler. The muffler reduces pollution by promoting further combustion of combustible constituents of the exhaust gases.

U.S. Pat. No. 5,371,331 to Wall describes a muffler for use on the exhaust system of the motor vehicle. The muffler has a central pipe which is surrounded by an outer pipe which leaves an annular space between the two. The outer pipe is open at both ends and the annular space is filled with a sound deadening material. The central pipe has openings which pass to the annular space and a perforated sound deadening member is affixed to the inner surface of the central pipe. Preferable, the outer pipe is outwardly flared at its upstream end, and the perforated sound deadening member is conical in shape.

Notwithstanding the prior art, the present invention is neither taught nor rendered obvious thereby.

SUMMARY OF THE INVENTION

The aspiration device for vehicle engine exhaust systems includes a main housing having a top, a bottom and sidewalls. The device has an open front and an open back. The open front has a larger cross-sectional area than the back and it is adapted to be mounted in the air stream of a moving vehicle. The device has an aerodynamic wing and a hollow inside with a wide leading edge and a narrow trailing edge. The aerodynamic wing can be mounted within the main housing such that the leading edge of the wing faces the open front of the main housing. The trailing edge of the aerodynamic wing faces the open back of the main housing. The wing is located within the main housing so as to permit passage of air over and under the wing when the device is mounted to the vehicle and the vehicle is moving forward. The wing has an exhaust outlet at the trailing edge and the wing has an exhaust inlet located on a sidewall of the main housing for attachment to a vehicle exhaust system. The exhaust inlet is located in any other position except at the trailing edge. The aerodynamic wing of the present invention aspiration device for vehicle engine exhaust systems has a coating of thermal insulation. The wing is also located within the main housing such that the main housing establishes sidewalls of the aerodynamic wing. The bottom of the main housing is hingedly connected to the main housing so as to adjust the cross-sectional area of the open front and of the open back. The present invention device has an automatic control device which causes or allows the bottom of the main housing to adjust the cross-sectional opening of at least one open front and at least one open back of the main housing in accordance with pre-determined adjustments as a function of speed of a vehicle.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention is directed to an aspiration device for vehicle engine exhaust systems for reducing engine load or work which is expended to force exhaust gases from the engine through the exhaust system. The present invention device is an adjunct to exhaust systems of fuel burning engines. In other words, the present invention device is connected to exhaust systems of engines which are utilized on vehicles which move. The present invention device requires a vehicle's movement through an air stream to function.

More specifically, the present invention device includes an aerodynamic wing which is uniquely designed to function within a final exhaust chamber and, in a fashion acts like an aerodynamic wing in a wind tunnel chamber providing predictable areas of increasing air velocity and areas of negative pressure. The present invention includes a housing with an open front and an open back and with generally closed side walls, top and bottom. The top and the bottom create a large open front and a small open back by being tapered relative to one another, with top and bottom surfaces being further apart at the front and closer together at the back. The aerodynamic wing is located within this housing and may have top and bottom wing surfaces which run parallel to the top and bottom of the housing, or they may be tapered relative to the top and bottom of the housing, with wider cross-sectional areas toward the front and narrower cross-sectional areas toward the back, above and below the wing.

Figure 1:
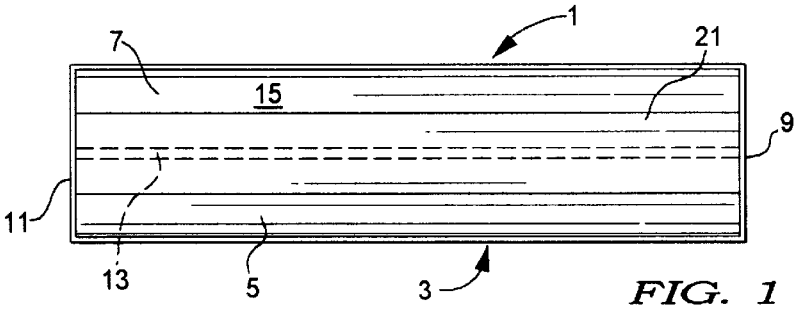
FIG. 1 shows a front view.
Figure 2:
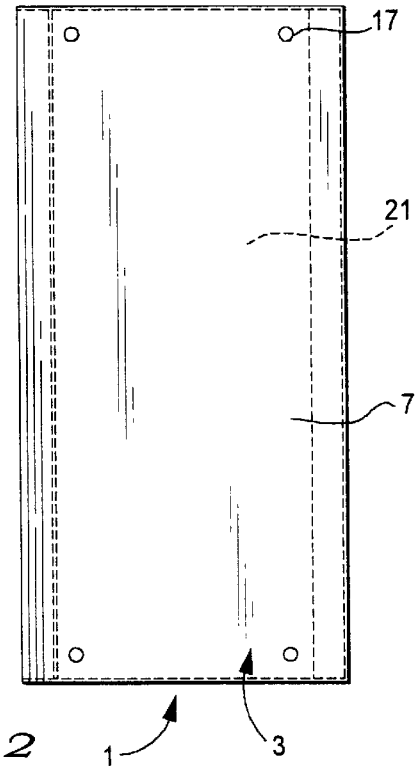
FIG. 2 shows a top view.
Figure 3:
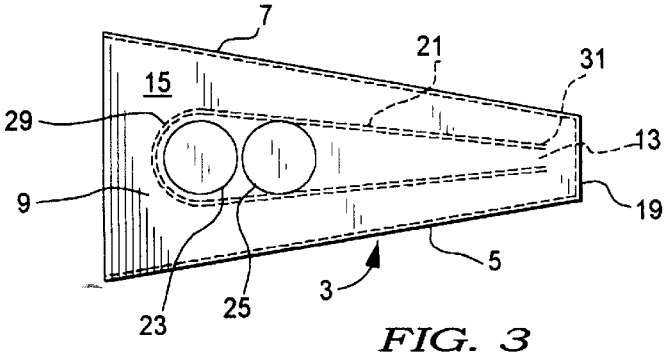
FIG. 3 shows an enlarged side view and FIG. 4 shows a rear view of one embodiment of the present invention aspiration device for vehicle engine exhaust systems.
Figure 4:
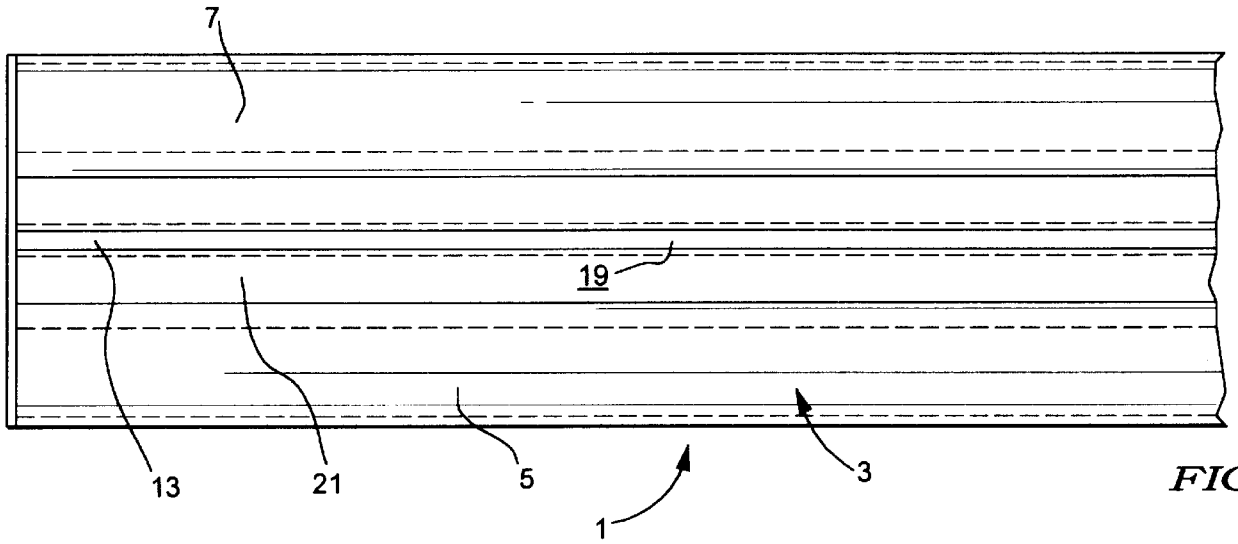

Referring more specifically to FIGS. 1 through 4, there is a present invention aspiration device 1 which includes a main housing 3 which has a bottom 5, top 7, and sidewalls 9 and 11. FIG. 1 shows a front view, FIG. 2 shows a top view, FIG. 3 shows an enlarged side view and FIG. 4 shows a rear view. There is an open front 15 and an open back 19 wherein the open front 15 has a larger cross-sectional area than the open back 19. The device 1 has means for, and is adapted to be mounted in the air stream of a vehicle. These means could include bolts when used in conjunction with the corner screw holes shown in FIG. 2 such as screw hole 17.

Aerodynamic wing 21 has a hollow inside and has a wide leading edge 29 and a narrow trailing edge 31. In this embodiment, leading edge 29 is like the front edge of a wing so that air travels above and below it and trailing edge 31 has an opening 13. Because leading edge 29 faces front 9 and trailing edge 31 faces open back 19, when device 1 is attached to the exhaust system or near an exhaust system of a vehicle, and that vehicle is moving forward, air rams into open front 9, travels over and under aerodynamic wing 21 and exits open back 19, the air acts to pull out exhaust fumes through opening 13. This is achieved by having exhaust pipes from the engine attached to aerodynamic wing 21 so that exhaust fumes enter into aerodynamic wing 21 and exit through opening 13. In the case of present invention device 1 sidewalls 9 and 11 are serving two functions, namely, as sidewalls for the housing 3 and as sidewalls for the aerodynamic wing 21. Thus, as shown in FIG. 3, exhaust inlets 23 and 25 are cut through sidewall 9 so that exhaust pipes may be attached thereto. Exhaust gases enter wing 21 through exhaust inlets 23 and 25 and are pulled out of opening 13 which acts as an exhaust outlet.

Figure 5:
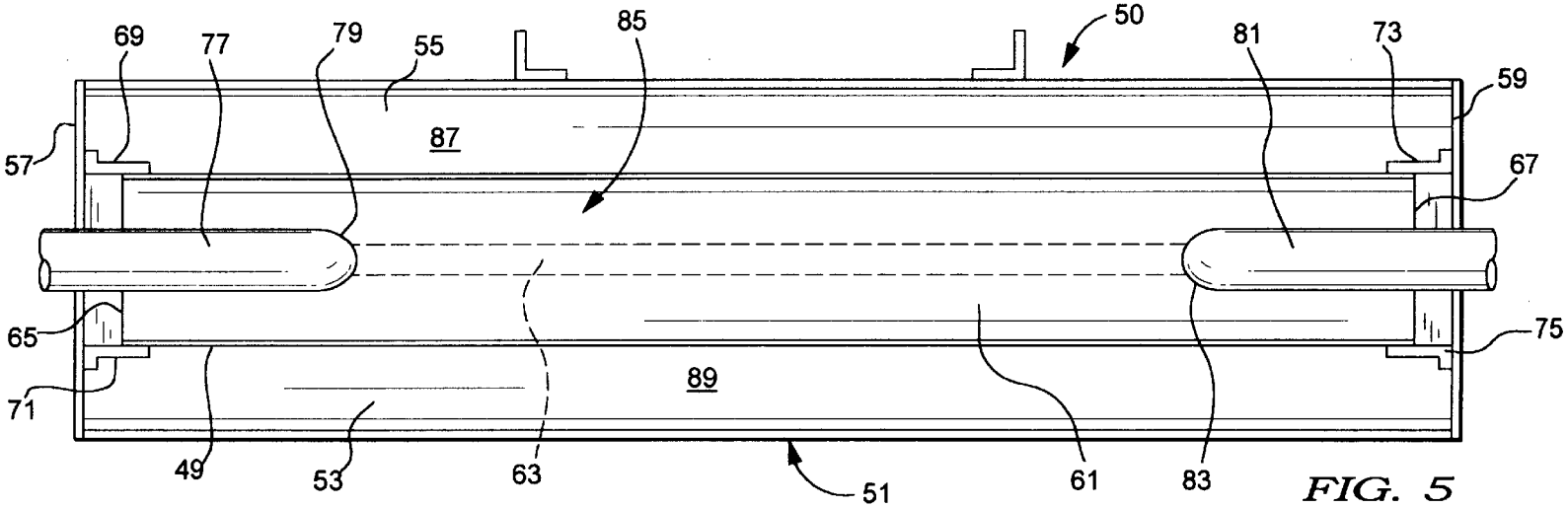
FIG. 5 shows an alternative embodiment of an aspiration device for vehicle engine exhaust system.

FIG. 5 shows a front view of an alternative present invention device 50 which has main housing 51 and an aerodynamic wing 85. Aerodynamic wing 85 is similar to that shown in the above Figures but has its own sidewalls 67 and 65 and is welded to housing sidewalls 57 and 59 via brackets 69, 71, 73 and 75. Its leading edge is facing the open front of housing 51 and has air spaces 87 and 89 above and below it. Housing top 55 and housing bottom 53 are tapered toward one another and have a smaller cross-sectional area at its back than at its front. Leading edge 61 has orifices 79 and 83 with exhaust pipes 77 and 81 connected thereto. The trailing edge of wing 85 has an exhaust outlet 63. There is a thin layer 49 of insulative coating on wing 85 which acts as heat insulation. Exhaust gases enter wing 85 through exhaust pipes 77 and 81 and exit through exhaust outlet 63. The high velocity air traveling around wing 85 creates a negative pressure within the trailing edge pulling the exhaust fumes out of wing 85 and decreases the engine load.

Figure 6:
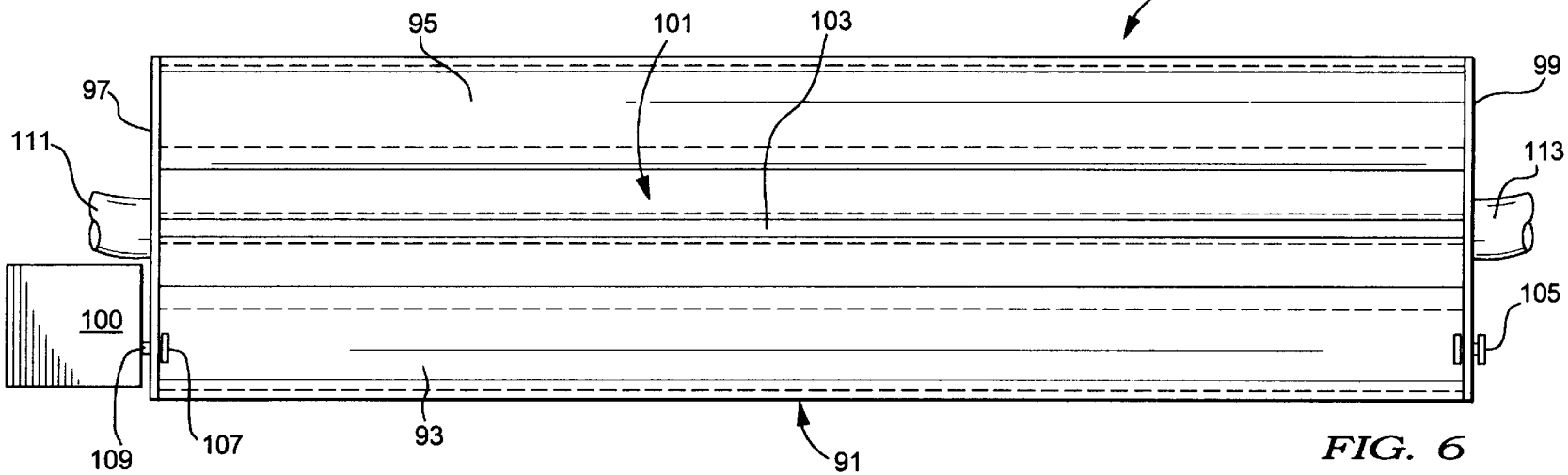
FIG. 6 shows a back view of another alternative embodiment present invention aspiration device for vehicle engine exhaust systems with a motor driven adjustable main housing bottom to increase or decrease air velocity as a function of vehicle speed; and, FIG. 7 shows a side view of another alternative embodiment present invention aspiration device for vehicle engine exhaust systems with a spring driven adjustable main housing bottom to change air velocity as a function of vehicle speed.

FIG. 6 shows yet another alternative embodiment present invention device 90 in its rear view. There is a housing 91 with a bottom 93, a top 95 and sidewalls 97 and 99. Wing 101 is directly connected to housing 91 as shown in FIG. 1, except that exhaust pipes 111 and 113 are connected to inlets on both sides of wing 101 instead of one side as shown in FIG. 1. In this particular embodiment, bottom 93 of housing 91 is hingedly connected to its sidewalls so that it may be rotated to increase and decrease the back end opening created between the back edges of bottom 93 and top 95 to increase or decrease air flow. Thus, in this case, motor 100 is attached to axle 109 and fixture 107 so that automatic, motorized adjustment is provided (opposite hinge point 105 is also shown.) Thus, motor 100 will pivot or rotate bottom 93 so as to not only further restrict the opening size of the housing back, or alternatively to expand it, but will also inherently be adjusting the relative position of bottom 93 with respect to the bottom surface of wing 101 so as to create a lesser or greater tapering between the two. Motor 100 may include a micro-processor which will adjust the device in response to vehicle speed or engine R.P.M.'s or both.

Figure 7:
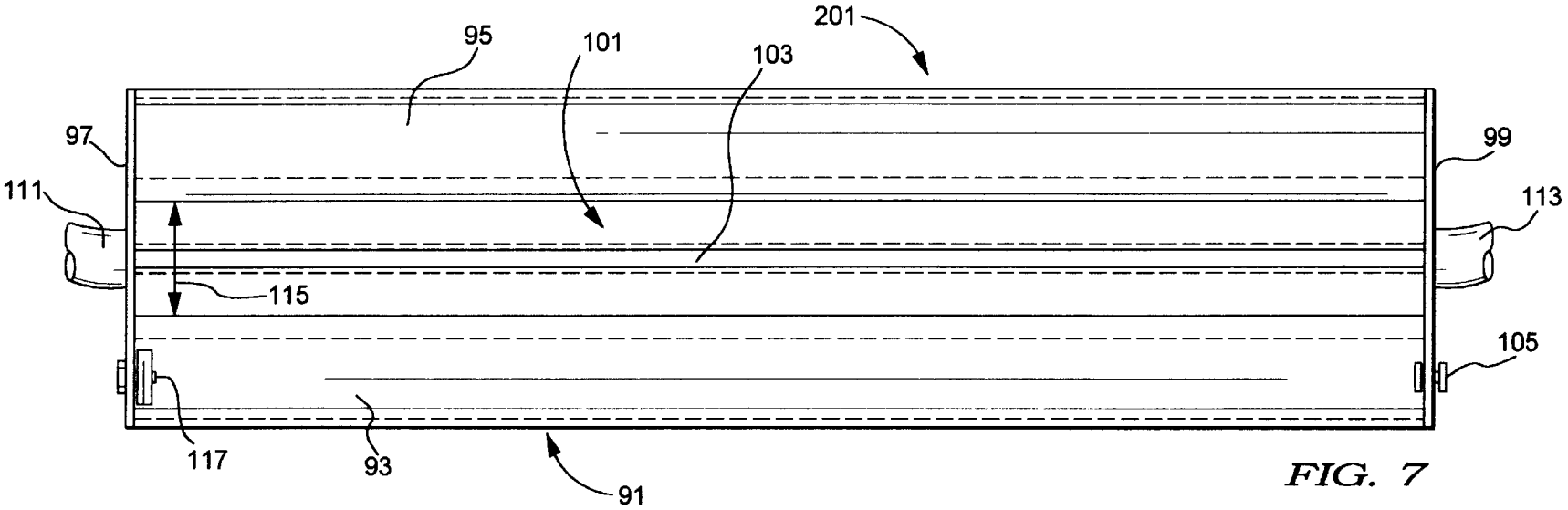

FIG. 7 shows the rear view of an embodiment similar to that shown in FIG. 6 except that there is a spring driven adjustable bottom instead of a motor driven adjustable bottom. Thus, parts identicle to those shown in FIG. 6 are identically numbered. In device 201, bottom 93 has a coil spring 117 attached thereto such that when a vehicle to which device 201 is attached travels at higher speeds, bottom 93 opens downwardly at its rear to increase the space shown by arrow 115 created between top 95 and bottom 93 to decrease vehicle drag and adjust air flow accordingly.

Obviously, numerous modifications and variations of the present invention are possible in light of the above teachings. It is therefore understood that within the scope of the appended claims, the invention may be practiced otherwise than as specifically described herein.

What is claimed is:

1. An aspiration device for vehicle engine exhaust systems, which comprises:

a) a main housing having a top, a bottom and sidewalls and having an open front and an open back, said open front having a larger cross-sectional area than said open back and adapted to be mounted in an air stream of a vehicle;

b) an aerodynamic wing having a hollow inside and having a wide leading edge and a narrow trailing edge, said aerodynamic wing being mounted within said main housing such that said leading edge of said wing faces the open front of said main housing and said trailing edge of said wing faces said open back of said main housing, said wing further being further located within said main housing so as to permit passage of air over and under said wing when said device is mounted in the air stream of a vehicle and said vehicle is moving forward, said wing having a width parallel to said top and said bottom of said housing and having a thickness parallel to said open front of said housing, wherein said width is greater than said thickness, said wing having an exhaust outlet at said trailing edge and said wing having an exhaust inlet for attachment to a vehicle exhaust pipe, said exhaust inlet being located in any other position thereon except at said trailing edge.

2. The aspiration device for vehicle engine exhaust systems of claim 1 wherein said exhaust inlet is at least one orifice located on a sidewall of said main housing.

3. The aspiration device for vehicle engine exhaust systems of claim 1 wherein at least one of said main housing and said aerodynamic wing has a coating of thermal insulation thereon.

4. The aspiration device for vehicle engine exhaust systems of claim 1 wherein said aerodynamic wing is encased on each side by said sidewalls of said main housing such that said main housing sidewalls establish sidewalls of said aerodynamic wing.

5. The aspiration device for vehicle engine exhaust systems of claim 1 wherein said bottom of said main housing is hingedly connected to said main housing so as to adjust the cross-sectional area of at least one of said open front and of said open back.

6. The aspiration device for vehicle engine exhaust systems of claim 5 wherein said bottom has an automatic control device which pivots said bottom of said main housing to adjust said cross-sectional opening of at least one of said open front and said open back of said main housing in accordance with pre-determined adjustments as a function of speed of a vehicle.

7. The aspiration device for vehicle engine exhaust systems of claim 5 wherein said bottom is hingedly connected to said main housing with hinge points located toward the open back of said main housing and with at least one spring moveably connecting said bottom to said main housing toward the open front of said main housing such that when said device is mounted to a motor vehicle and said vehicle is moving forward, said at least one spring has a predetermined yield so as to permit downward movement of said bottom as a function of increasing air pressure relating to vehicle speed.

* * * * *